US006755248B2

(12) United States Patent
Toulouse et al.

(10) Patent No.: US 6,755,248 B2
(45) Date of Patent: Jun. 29, 2004

(54) ONE TRIP THROUGH TUBING WINDOW MILLING APPARATUS AND METHOD

(75) Inventors: Jeffrey E. Toulouse, Aberdeen (GB); Malcolm D. Pitman, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/109,140

(22) Filed: Mar. 28, 2002

(65) Prior Publication Data

US 2003/0183388 A1 Oct. 2, 2003

(51) Int. Cl.[7] ..... E21B 7/08; E21B 29/06

(52) U.S. Cl. ..... 166/255.3; 166/117.6; 166/117.5; 175/80

(58) Field of Search ..... 166/117.6, 117.5, 166/55, 55.1, 55.3, 55.7, 55.8, 255.3; 175/45, 80, 81

(56) References Cited

U.S. PATENT DOCUMENTS

| | | | | |
|---|---|---|---|---|
| 5,195,591 A | | 3/1993 | Blount et al. | |
| 5,222,554 A | * | 6/1993 | Blount et al. | 166/117.6 |
| 5,287,921 A | * | 2/1994 | Blount et al. | 166/117.6 |
| 5,443,129 A | * | 8/1995 | Bailey et al. | 175/45 |
| 5,488,989 A | * | 2/1996 | Leising et al. | 166/117.6 |
| 5,494,111 A | * | 2/1996 | Davis et al. | 175/81 |
| 5,647,437 A | | 7/1997 | Braddick et al. | |
| 5,775,428 A | * | 7/1998 | Davis et al. | 166/117.6 |
| 5,826,651 A | * | 10/1998 | Lee et al. | 175/80 |
| 5,909,770 A | | 6/1999 | Davis | |
| 5,911,275 A | | 6/1999 | McGarian et al. | |
| RE36,526 E | | 1/2000 | Braddick | |
| 6,050,334 A | * | 4/2000 | McGarian et al. | 175/80 |
| 6,102,123 A | * | 8/2000 | Bailey et al. | 175/80 |
| 6,105,675 A | * | 8/2000 | Buytaert et al. | 166/298 |
| 6,109,347 A | * | 8/2000 | Ferguson et al. | 166/298 |
| 6,167,961 B1 | | 1/2001 | Pollard et al. | |

FOREIGN PATENT DOCUMENTS

WO WO 01/07749 A1 2/2001

* cited by examiner

*Primary Examiner*—David Bagnell
*Assistant Examiner*—Brian D Halford
(74) *Attorney, Agent, or Firm*—Steve Rosenblatt

(57) ABSTRACT

A one-trip through tubing window milling system is disclosed. The whipstock is delivered with the mill and downhole motor in a downhole assembly which further includes MWD equipment for proper whipstock orientation. The entire assembly is run through tubing and the MWD equipment orients the whipstock. A motor lock prevents the downhole motor from turning as fluid pressure is applied to properly anchor the whipstock below the production tubing. The motor lock is defeated and the milling commenced using the downhole motor. At the conclusion of the window milling, the bottom hole assembly, including the mill, is removed and a retrieving tool releases the whipstock for retrieval through the production tubing.

13 Claims, 5 Drawing Sheets

ONE TRIP THROUGH TUBING WINDOW MILLING APPARATUS AND METHOD

FIELD OF THE INVENTION

The field of this invention relates to window milling systems which can be accomplished through the production tubing in a single trip.

BACKGROUND OF THE INVENTION

Many times in the history of producing wells, a lateral opening must be milled in the casing in order to continue production from an existing well. In the past it has been advantageous to be able to set a whipstock and mill a window without removing the production tubing. These techniques involve the use of a retrievable whipstock which is insertable through tubing. A good example of a through tubing retrievable whipstock is U.S. Pat. No. 5,909,770. In some instances in the past, a through tubing non-retrievable whipstock has been used in a multiple trip system for milling a window in a casing. In U.S. Pat. No. Re 36,526 a through tubing non-retrievable whipstock is delivered through tubing and anchored in the casing. A separate trip is involved in delivering the mill or mills to mill the window in the casing.

In the past, whipstocks have been oriented downhole using measurement while drilling technology known as MWD. MWD tools required high flow rates for operation in orienting the whipstock appropriately. In the past, mills have been driven by downhole motors, generally of the progressing cavity type, involving a fixed stator and a rotating rotor driven by fluid flow through the stator.

One of the impediments in the past to running one-trip through tubing systems for milling windows, has been that use of applied pressure to set a whipstock anchor if delivered through the downhole motor would start the motor turning, which would prematurely break the mill loose from the whipstock prior to proper setting of the whipstock or it would alternatively rotate the whipstock. Accordingly, in developing the one-trip through tubing window milling system of the present invention, a motor lock has been developed for the downhole motor to prevent movement of the rotor as the anchor for the whipstock is being set. The apparatus and method of the present invention also envision hydraulically setting an anchor for the through tubing whipstock while having a way to retrieve the whipstock after the window is milled. The hydraulic anchoring assembly is preferred, particularly in deviated well applications due to the difficulties in properly actuating mechanically any anchor for the whipstock. The retrieval of the whipstock after the window milling necessarily involves release of the whipstock anchor to facilitate the removal of the whipstock through tubing. Accordingly, the present invention truly discloses a one-trip through tubing system for window milling whose details will be apparent to those of ordinary skill in the art from reading the detailed description of the preferred embodiment which appears below.

SUMMARY OF THE INVENTION

A one-trip through tubing window milling system is disclosed. The whipstock is delivered with the mill and downhole motor in a downhole assembly which further includes MWD equipment for proper whipstock orientation. The entire assembly is run through tubing and the MWD equipment orients the whipstock. A motor lock prevents the downhole motor from turning as fluid pressure is applied to properly anchor the whipstock below the production tubing. The motor lock is defeated and the milling commenced using the downhole motor. At the conclusion of the window milling, the bottom hole assembly, including the mill, is removed and a retrieving tool releases the whipstock for retrieval through the production tubing.

DETAILED DESCRIPTION OF THE DRAWINGS

DETAILED DESCRIPTION OF THE PREFERRED EMBODIMENT

Figure 1:
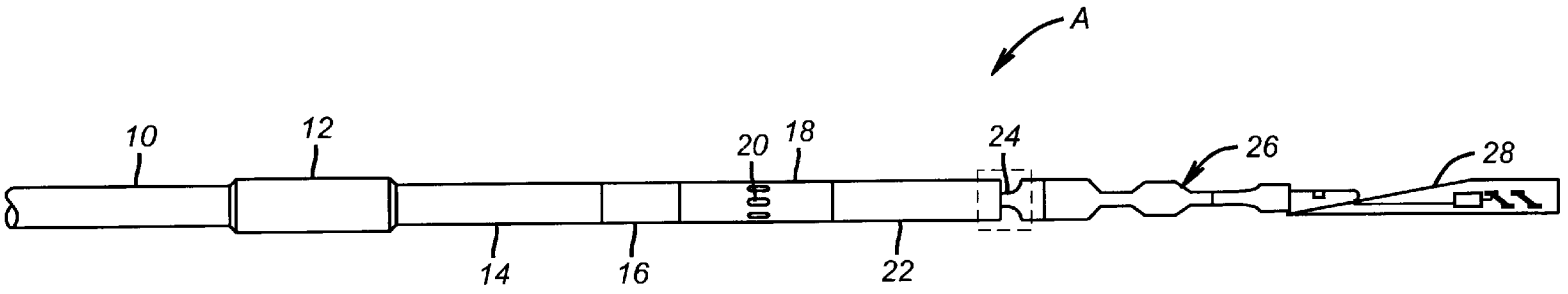
FIG. 1 is a schematic of the bottom hole assembly for the apparatus and method of the present invention.

Referring to FIG. 1, the apparatus A may be delivered on coiled tubing 10 or in the alternative, rigid tubing. Connected to the lower end of coiled tubing 10 is a motor head assembly 12. The motor head assembly is a tool that combines several tools to reduce overall length, such as a connector and flapper valves. Below the motor head assembly 12 is an MWD tool 14. In the preferred embodiment, the motor head assembly 12 can be one that is provided by Baker Oil Tools under Product Family No. H13203. The MWD tool 14 is of a type known in the art which uses mud pulse telemetry to relay back to the surface downhole parameters of inclination orientation as well as other properties. The MWD equipment can be omitted if the direction of the lateral is not important.

Located below the MWD tool 14 is an orienting tool 16, one example of which is Baker Oil Tools Product No. 132-61. The orienting tool 16 offers the ability to orient a milling assembly during a through tubing operation. This tool is actuated using back pressure created by pumping through the retrieving tools or workover motor which can be mounted below. In operation, the internal pressure causes a piston in this tool to shift causing the housing to rotate. When the pressure is reduced, the tool resets to allow the next orientation cycle. This tool has the capability of being prevented from free rotation in either direction.

Located below the orienting tool 16 is a whipstock valve 18. One example of a whipstock valve 18 is Baker Oil Tools Product Family H15036. This type of equipment allows operation of MWD equipment in conjunction with a milling system to allow a one trip operation. In this particular application, it allows the MWD tool 14 to operate to orient a whipstock as will be explained below. This valve is actuated by hydraulic signals such as varying the flow rate. This valve is normally open to facilitate the operation of the MWD tool 14 and after the flow rate is raised considerably, the bypass valve 20 will close to permit setting of the whipstock anchor as will be described below.

Below the whipstock valve 18 is the mud motor 22. This is a progressing cavity type motor in the preferred embodiment, one example of which is the line of work over motors available form the Inteq Division of Baker Hughes.

Figure 3:
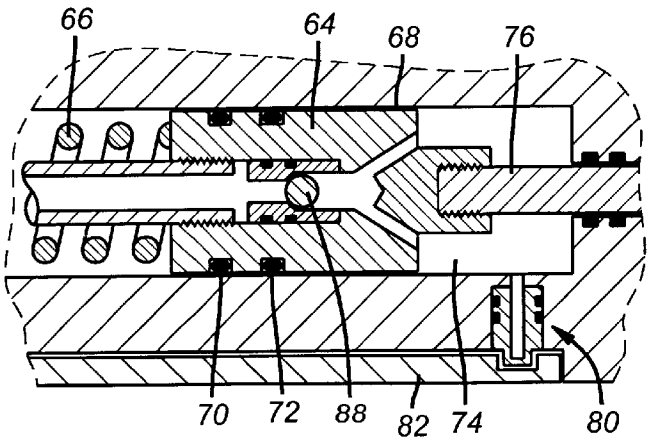
FIG. 3 is a sectional view of the whipstock anchoring system, including a detail of the piston actuator.
Figure 3:
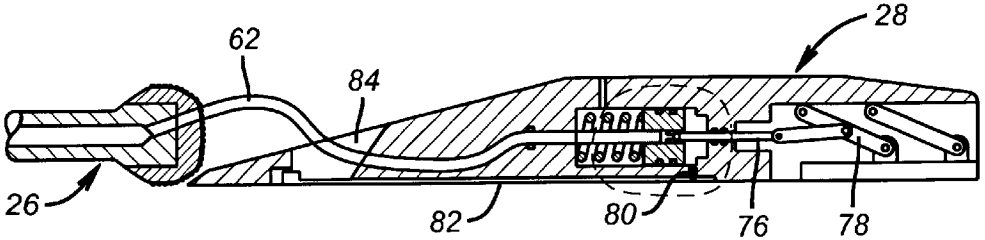

Located below the mud motor 22 is the lock 24 shown in more detail in FIG. 2. Below lock 24 is the milling system 26 which is in turn connected to the whipstock 28. The details of the whipstock 28 are shown in FIG. 3.

Figure 4:
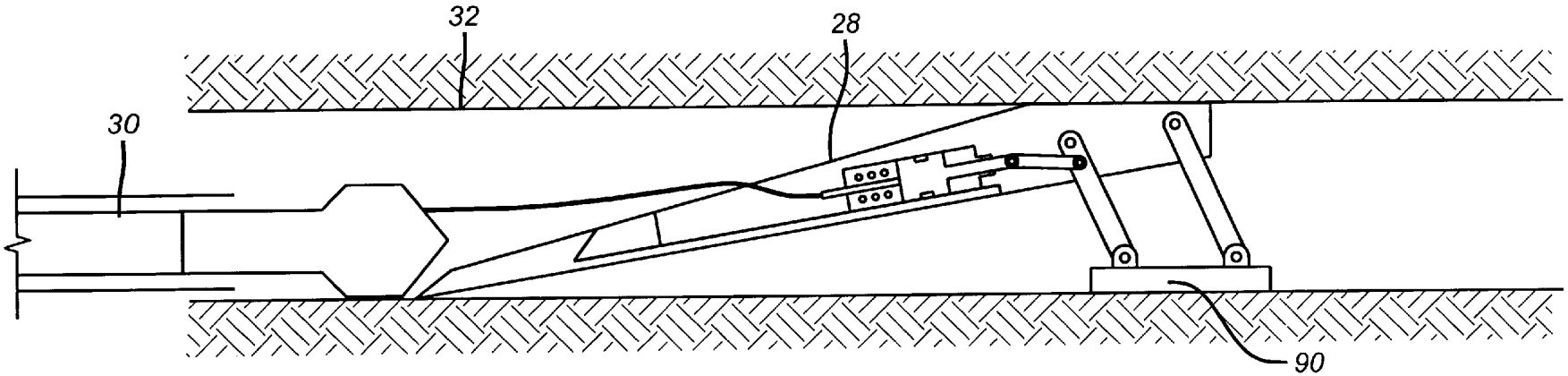
FIG. 4 is a sectional view showing the whipstock anchored in place prior to milling.

The entire assembly of FIG. 1 is made so that it will fit through the production tubing 30 which is in turn inside the casing 32 as illustrated schematically in FIG. 4.

Figure 2:
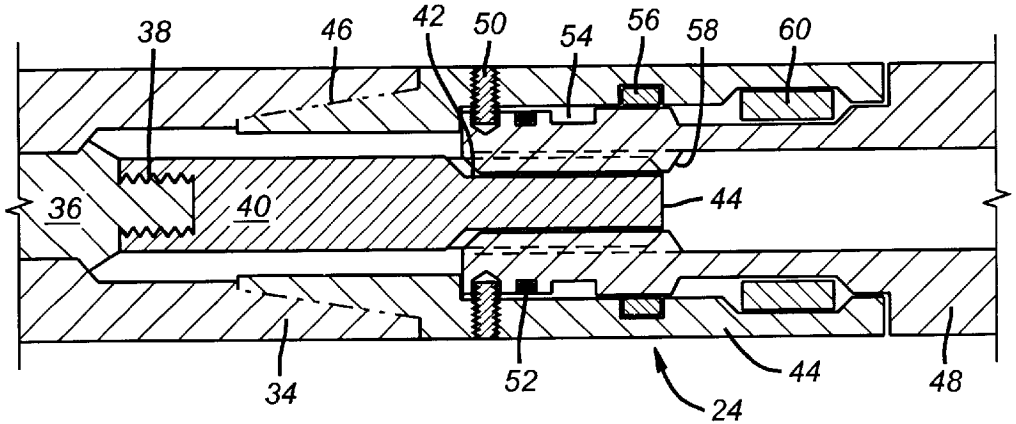
FIG. 2 is a sectional view showing the motor lock in the engaged position.

The operation of the lock 24 is best understood by looking at FIG. 2. The mud motor 22 has a stator 34 inside of which is a rotor 36. A thread 38 at the lower end of the rotor 36 is used to engage the splined extension 40. The splined extension 40 is simply a round shaft having a series of longitudinal splines 42 at a lower end 44.

Figure 2A:
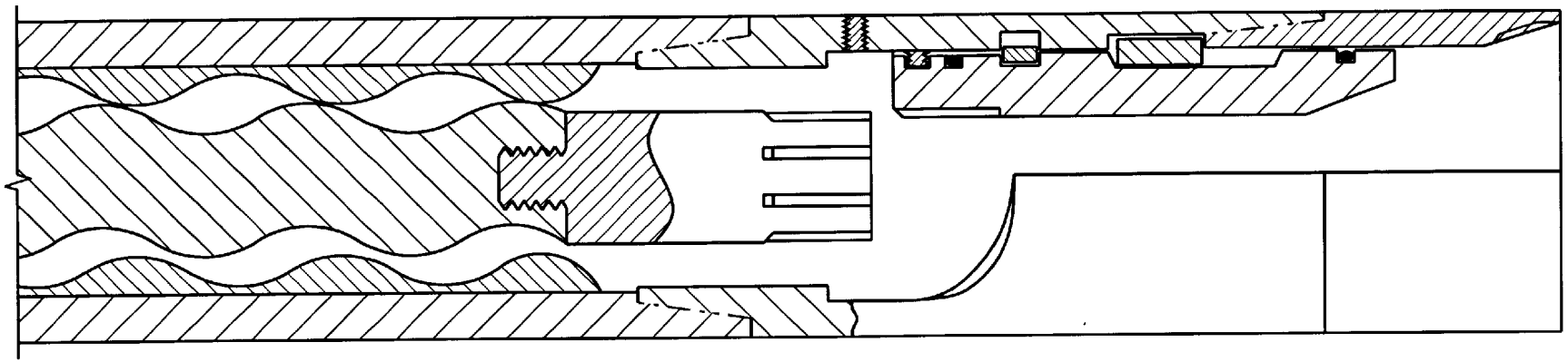
FIG. 2*a* is the view of FIG. 2 in the unlocked position.
Figure 8:
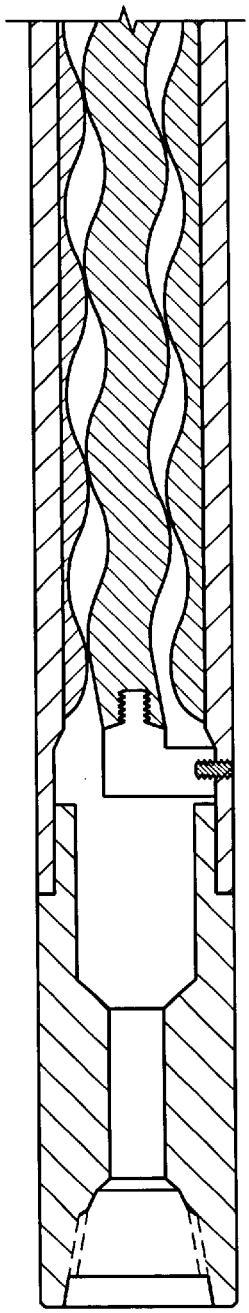
FIGS. 8 and 9 are alternative locks to the preferred design shown in FIGS. 2 and 2*a*.
Figure 9:
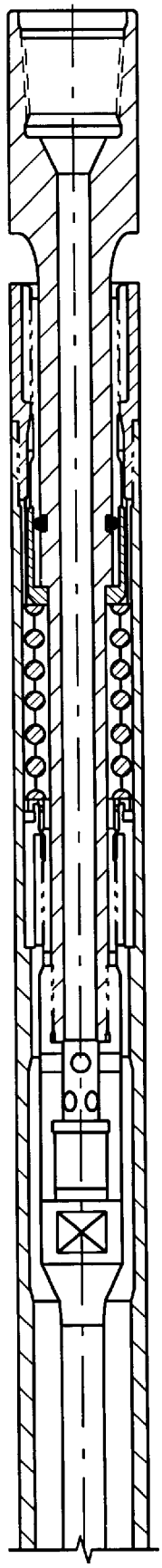

Secured to the stator 34 is a bottom sub 44 which is attached at thread 46. Top sub 48 is releasably secured to the bottom sub 44 with a shear pin or pins 50. Top sub 48 also includes an o-ring seal 52 to provide a seal between itself and the bottom sub 44. Further, the top sub 48 includes a circular groove 54. The bottom sub 44 has a split c-ring 56. In the run in position shown in FIG. 2, the c-ring 56 is held to the bottom sub 44. Ultimately, as shown in FIG. 2*a*, when there is relative movement between the bottom sub 44 and the top sub 48, groove 54 comes into alignment with c-ring 56 to lock the relative positions between the bottom sub 44 and top sub 48 in a manner where the splines 42 are no longer retained by splines 58 on the top sub 48. This occurs because of pressure build up which breaks the shear pin 50 and longitudinally shifts the top sub 48 taking with it the splines 58. Splines 58 move downwardly sufficiently so that when the c-ring 56 expands into groove 54, the rotor 36 is free to rotate. Once the lock 24 shown in FIG. 2 is shifted to its unlocked position with c-ring 56 and groove 54, it cannot return to the original position shown in FIG. 2. In the run in position shown in FIG. 2, a torque pin 60 prevents relative rotation between the top sub 48 and the bottom sub 44 for transmission of rotational inputs to the whipstock 28 for its proper positioning. The presence of the torque pin 60 does not preclude the longitudinal shifting of the top sub 48 which is necessary to unlock the rotor 36 in the manner previously described. Alternative locks are shown in FIGS. 8 and 9. FIG. 8 shows an offset boss to lock the rotor 36 to the stator 34. FIG. 9 shows a shearable key on the bottom of the bearing housing extending into the upset of the drive sub.

Figure 6:
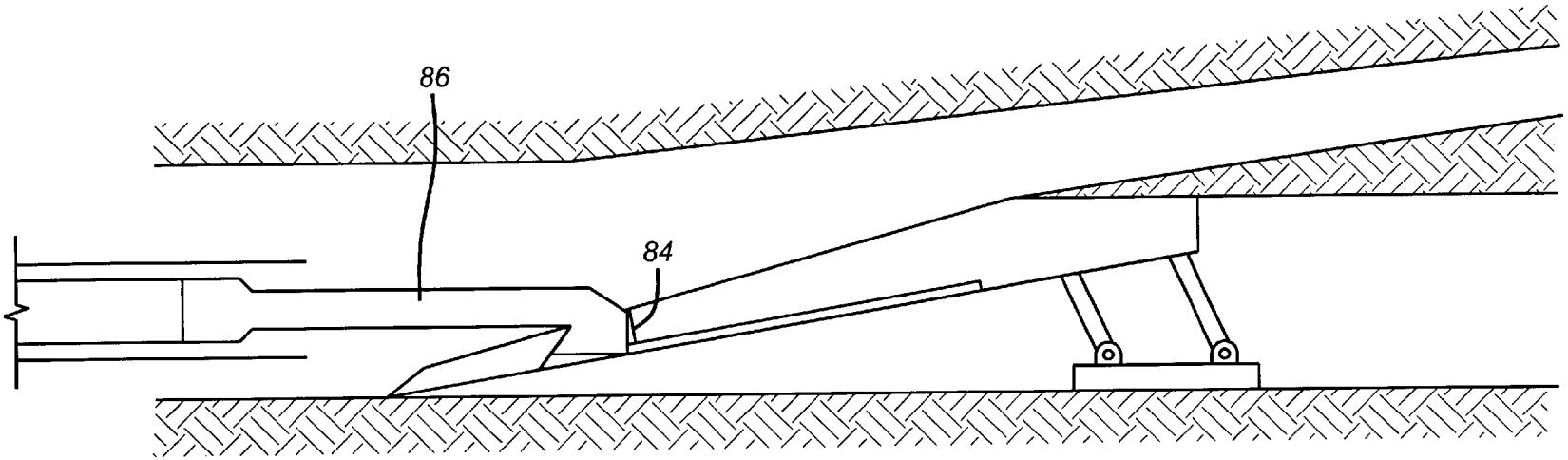
FIG. 6 shows the insertion of the retrieval tool for removal of the whipstock after the window has been milled.
Figure 7:
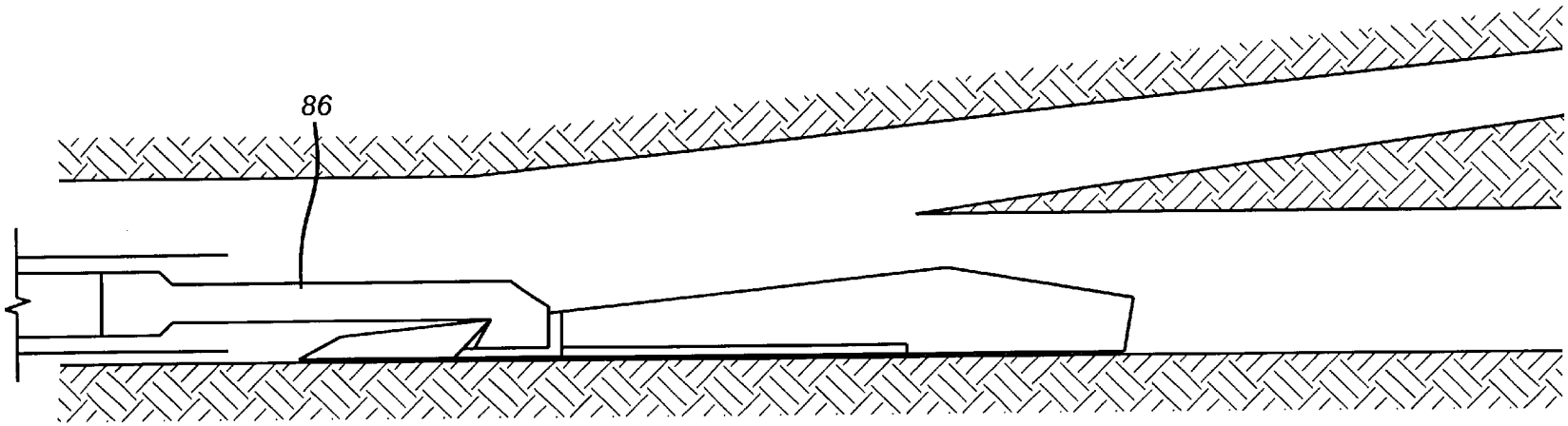
FIG. 7 is the view of FIG. 6 with the whipstock anchor defeated prior to removal of the whipstock through the production tubing.

Referring now to FIG. 3, the anchoring procedure for the whipstock 28 will be described. The milling system 26 has a hose 62 connected to a piston 64. Piston 64 is biased by spring 66. Piston 64 is mounted in housing 68 and has seals 70 and 72. Seal 70 and 72 define an enclosed chamber 74 which has variable volume on piston movement. Extending through chamber 74 is a drive rod 76 which extends to a linkage 78 shown in FIG. 3 in the run-in position. A shear valve 80 is connected to a shear rod 82. Shear rod 82 extends into retrieving slot 84. The shear rod 82 is engagable in retrieving slot 84 by a retrieving tool 86 as shown in FIG. 6. The piston 64 has a check valve 88 which allows flow from hose 62 to enter chamber 74 and increase its volume while at the same time compressing spring 66 as the piston 64 moves upwardly. Upward movement of the piston 64 takes with it the drive rod 76 which in turn puts an upward pull on the linkage 78. This in turn drives the gripping bar 90 into the casing 32 wedging the whipstock 28 against the casing 32 as shown in FIG. 4. The retrieving tool 86 ultimately moves the shear rod 82 which breaks the shear valve 80 which vents accumulated pressure in chamber 74 thus allowing spring 66 to bias the piston 64 to the right making chamber 74 have a smaller volume as fluid is expelled from the broken shear valve 80. An upward pull on the retrieving tool 86 brings out the whipstock 28 after the window has been milled as will be described below.

Figure 5:
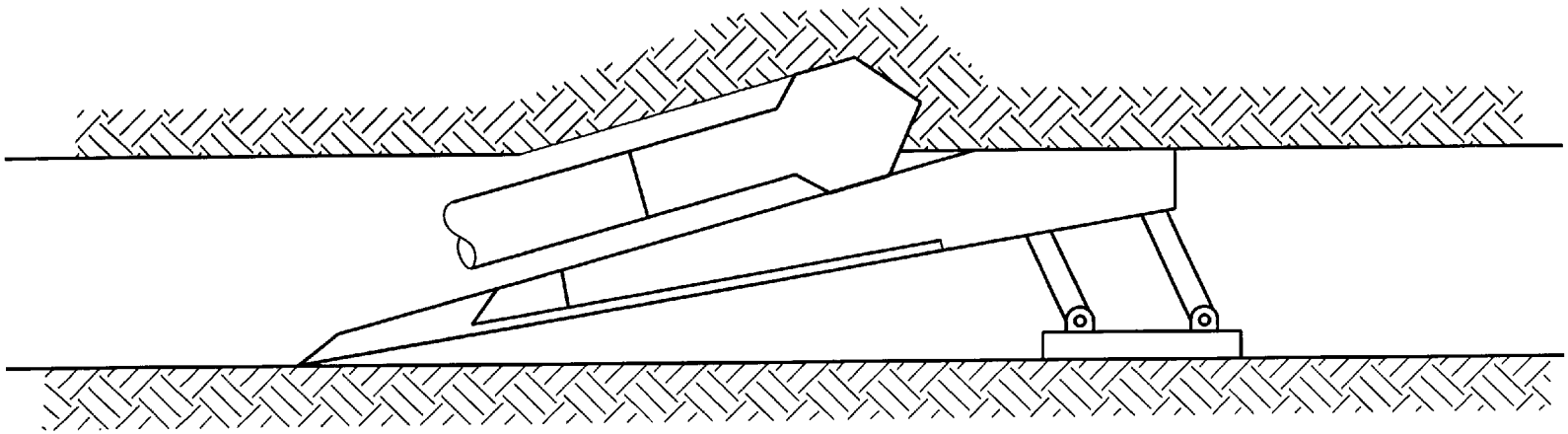
FIG. 5 is a sectional view showing the onset of milling.

The assembly shown in FIG. 1 is run through the tubing 30 to get the whipstock 28 in the desired depth. Circulation is established through the MWD tool 14 which exits through the whipstock valve 18. When the proper orientation has been achieved, the flow is increased to close the bypass valve 20 on the whipstock valve 18. This allows for pressure buildup in hose 62 which in turn forces piston 64 against spring 66. The final position of the piston 64 is held by the presence of the check valve 88. Upward movement of the piston 64 pulls up the drive rod 76 which in turn actuates the linkage 78 to wedge the gripper bar 90 against the casing 32. At this time the whipstock 28 is secured in the proper orientation. The same pressure buildup in hose 62 also acts to put a downward force on top sub 48 ultimately breaking the shear pin or pins 50 and allowing the top sub 48 to shift until the c-ring 56 expands into the groove 54 locking the lock 24 in the unlocked position. This in turn allows the rotor 36 to rotate as the splines 42 on spline extension 40 are no longer engaged to the splines 58 on the top sub 48. The milling operation can now take place as illustrated in FIG. 5. At the conclusion of the milling operation, the assembly shown in FIG. 1, except for the now anchored whipstock 28, is removed from the wellbore through the tubing 32. Inserted through the tubing 32 is a retrieving tool 86, which extends into the retrieving slot 84 as shown in FIG. 6. An upward pull on the retrieving tool 86 when in retrieving slot 84, results in up hole actuation of the shear rod 82 which breaks the shear valve 80. This in turn allows the fluid in chamber 74 to escape. This in turn allows the spring 66 to bias the piston 64 in the downhole direction which in turn acts to collapse the linkage 78. An upward pull on the retrieving tool 86 fully collapses the linkage to allow retrieval of the whipstock 28 through the tubing 30.

Those skilled in art can appreciate that the preferred embodiment has been revealed and that there are other techniques available to accomplish the desired goals of the present invention. The lock 24 can be released by a pickup force to break the shear pin 50. Alternatively, as previously described, hydraulic pressure can be used. Yet another alternative could involve using electrical current to be applied to a solenoid to place the lock 24 in the released position where the rotor 36 can rotate. The assembly revealed in FIG. 1 allows a whipstock 28 to be run, oriented and set when run below a motor and milling assembly on coil tubing or drill pipe. A one trip system for through tubing window milling is now made possible. Downhole motors in combination with coil tubing allow the window to be milled through tubing when rotating the drill string is not feasible. The lock 24 prevents free rotation of the mud motor 22 which is necessary when coil tubing is used as the work string to prevent running of the milling assembly when the whipstock is set. Without the lock 24, the whipstock would rotate on application of fluid through the motor 22. The lock 24 can be built into the downhole motor 22 or can be a separate assembly.

While the preferred embodiment has been set forth above, those skilled in art will appreciate that the scope of the invention is significantly broader and as outlined in the claims which appear below.

We claim:

1. A method of window milling comprising:

connecting a mill to a whipstock;

providing an anchor for the whip stock;

running said mill, whipstock and anchor together through well tubing and out of the lower end of said well tubing;

anchoring the whipstock in a larger tubular below said well tubing;

milling the window.

2. The method of claim 1, further comprising:

orienting the whipstock prior to said anchoring.

3. The method of claim 2, further comprising:

connecting a downhole motor to said mill before running said mill and whipstock through well tubing.

4. A method of window milling comprising:

connecting a mill to a whipstock;

running said mill and whipstock together through well tubing and out of the lower end of said well tubing;

anchoring the whipstock in a larger tubular below said well tubing;

milling the window; orienting the whipstock prior to said anchoring;

connecting a downhole motor to said mill before running said mill and whipstock through well tubing;

using a fluid driven motor as said downhole motor;

releasably locking a rotor on said fluid driven motor.

5. The method of claim 4, further comprising:

using fluid pressure to accomplish said anchoring.

6. The method of claim 5, further comprising:

removing said mill through said tubing;

inserting a retrieving tool through said well tubing;

removing said whipstock through said well tubing.

7. The method of claim 6, further comprising:

using a linkage connecting said whipstock and a gripping member as an anchor for said whipstock;

actuating said linkage to an anchoring position with said fluid pressure.

8. The method of claim 7 further comprising:

using said retrieving tool to relieve fluid pressure;

relaxing said linkage due to said fluid pressure relieving.

9. The method of claim 7, further comprising:

providing a piston in a housing;

connecting an actuator rod to said piston near one end and to said linkage near the other end;

applying fluid pressure to move said piston and said actuator rod to expand said linkage.

10. The method of claim 9, further comprising:

retaining pressure on said piston in a chamber of said housing;

providing a bias on said piston to oppose said retained pressure in said housing;

using said retrieving tool to release said pressure from said chamber.

11. The method of claim 10, further comprising:

providing a valve on said chamber and an operator for said valve extending into a retrieving slot in said whipstock;

moving said operator with said retrieving tool;

allowing said piston to be biased as a result of said pressure releasing.

12. The method of claim 4, further comprising:

using mechanical, fluid pressure or electrical power to unlock said rotor for rotation.

13. The method of claim 4, further comprising:

using a shiftable spline to selectively engage a spline on said rotor for said locking;

separating said splines;

locking said splines in a separated position.

* * * * *